US007676948B2

(12) United States Patent
Miles

(10) Patent No.: US 7,676,948 B2
(45) Date of Patent: Mar. 16, 2010

(54) TAPE DISPENSER FOR CHILDREN

(76) Inventor: Tammie Miles, 119 N. Parker, #357, Olathe, KS (US) 66061

( * ) Notice: Subject to any disclaimer, the term of this patent is extended or adjusted under 35 U.S.C. 154(b) by 221 days.

(21) Appl. No.: 11/827,558

(22) Filed: Jul. 13, 2007

(65) Prior Publication Data

US 2008/0010848 A1 Jan. 17, 2008

Related U.S. Application Data

(60) Provisional application No. 60/831,168, filed on Jul. 17, 2006.

(51) Int. Cl.
*G01B 3/10* (2006.01)

(52) U.S. Cl. ..... 33/758; 33/768; 33/770

(58) Field of Classification Search ..... 33/755, 33/758, 759, 760, 768, 769, 770
See application file for complete search history.

(56) References Cited

U.S. PATENT DOCUMENTS

| | | | | | |
|---|---|---|---|---|---|
| 714,553 | A | | 11/1902 | Armstrong | |
| 889,714 | A | | 6/1908 | MacDonald | |
| 1,118,707 | A | | 11/1914 | Wakefield | |
| 2,071,225 | A | * | 2/1937 | Buttigieg | 33/767 |
| D113,721 | S | | 3/1939 | Rosenbaum et al. | |
| 3,107,814 | A | * | 10/1963 | Auger et al. | 221/73 |
| D197,934 | S | | 4/1964 | Weaver | |
| 3,206,889 | A | | 9/1965 | Ryan | |
| 3,283,886 | A | * | 11/1966 | Addis et al. | 242/588.6 |
| 3,740,299 | A | * | 6/1973 | Schroter | 156/577 |
| 3,913,246 | A | * | 10/1975 | Wahlberg et al. | 434/309 |
| 4,499,678 | A | | 2/1985 | Moreau | |
| 4,667,412 | A | * | 5/1987 | Carlson | 33/760 |
| 4,850,924 | A | | 7/1989 | Becker | |
| D305,249 | S | | 12/1989 | Ukisn | |
| 4,884,734 | A | * | 12/1989 | Kahl et al. | 225/26 |
| 4,896,432 | A | * | 1/1990 | Kang | 33/768 |
| D322,280 | S | * | 12/1991 | English | D19/4 |
| D322,281 | S | * | 12/1991 | English | D19/6 |
| 5,290,390 | A | | 3/1994 | Roman et al. | |
| 5,318,469 | A | | 6/1994 | Unalp et al. | |
| 5,391,106 | A | * | 2/1995 | Lidert, Jr. | 446/337 |
| 5,421,765 | A | | 6/1995 | Lehmann et al. | |
| 5,562,328 | A | | 10/1996 | Schottenfeld | |
| 5,720,617 | A | | 2/1998 | Var | |
| 5,806,714 | A | * | 9/1998 | Geiger | 221/73 |
| RE36,143 | E | | 3/1999 | Kind et al. | |
| 5,957,692 | A | | 9/1999 | MacCracken | |
| 5,996,932 | A | | 12/1999 | Wang | |
| 6,004,185 | A | * | 12/1999 | Rehkemper et al. | 446/317 |
| 6,004,597 | A | | 12/1999 | Coleman et al. | |
| 6,029,296 | A | * | 2/2000 | Terrell | 5/639 |
| D435,594 | S | | 12/2000 | Polidoro | |
| D443,646 | S | | 6/2001 | Bayer et al. | |
| 6,247,934 | B1 | | 6/2001 | Cogliano | |
| 6,386,261 | B1 | | 5/2002 | Sieber et al. | |
| 6,681,830 | B1 | * | 1/2004 | Vulpitta et al. | 156/527 |
| 6,918,509 | B2 | | 7/2005 | Baker et al. | |

(Continued)

*Primary Examiner*—Yaritza Guadalupe-McCall
(74) *Attorney, Agent, or Firm*—David E Herron, II

(57) ABSTRACT

The disclosure depicts a children's tape dispenser and method that incorporates it into practice. The apparatus has a housing in the form of a toy, and has a tape coil positioned within the housing. Tape having a gentle and nonpermanent adhesive is dispensed underneath the apparatus as it is moved across a surface.

17 Claims, 10 Drawing Sheets

U.S. PATENT DOCUMENTS

| | | | | |
|---|---|---|---|---|
| D515,628 | S | 2/2006 | Anduss | |
| 7,077,185 | B2 * | 7/2006 | Steinberger | 156/527 |
| 7,255,767 | B2 * | 8/2007 | Rice et al. | 156/253 |
| 2001/0042315 | A1 * | 11/2001 | Dixon | 33/758 |
| 2002/0193964 | A1 * | 12/2002 | Hsu | 702/161 |
| 2004/0045460 | A1 | 3/2004 | Huang | |
| 2005/0211185 | A1 | 9/2005 | Jenkins | |
| 2006/0076384 | A1 * | 4/2006 | Dickie | 225/39 |
| 2006/0123650 | A1 * | 6/2006 | Mullins | 33/566 |
| 2006/0191642 | A1 | 8/2006 | Chern | |
| 2006/0258255 | A1 | 11/2006 | Armenise | |

* cited by examiner

TAPE DISPENSER FOR CHILDREN

SUMMARY OF THE INVENTION

The invention is a novel apparatus for dispensing decorative tape onto a surface; it is also a method for providing the same.

The Inventive Apparatus

The inventive apparatus is a toy, namely a tape dispenser for children that includes a housing forming a selected toy shape, and a tape coil positioned within the housing. The housing and the coil are cooperatively configured to emit a ribbon of tape from an underside of the housing. The underside of the housing is configured to engage the surface so that a ribbon of tape adheres thereto.

The tape has a gentle and nonpermanent adhesive on a first side; and selected indicia on the second side. As the apparatus is moved across the surface, the tape exits the apparatus and adheres to the surface.

The apparatus may also include a means for biasing the tape into contact with the surface. In a preferred embodiment, the indicia comprise at least one of alphabetic characters, numerals, animals, railroad tracks, or fruit likenesses, or the like. In a preferred embodiment, the indicia may comprise removable stickers. Additionally, the indicia may include textured forms, or raised letters or indicia that will stimulate a child's sense of touch. Moreover, the raised letters may also include Braille letters (either by themselves or adjacent textured alphanumeric figures), thereby providing a learning device for visually impaired children.

Because the apparatus is well-suited as a plaything for children, indicia may be chosen to include any figure that is known to appeal to children, such as any cartoon character, superhero, character from a movie, or the like. Additionally, the housing may form the shape of any item that is well-suited for a children's plaything, such as a turtle, train, car, bus, ladybug, insect, animal, plane, or fish.

The apparatus may also include a first roller positioned on the underside of the housing, wherein the tape rolls across the first roller when the apparatus is moved across the surface. The invention may also include a cutter to cut the tape.

Preferably, the tape has an adhesive side bearing a gentle and non-permanent adhesive, and a top side that may have indicia imprinted thereon. The indicia may bear numerous forms, as shown. In a preferred embodiment, the indicia appears in the likeness of a road having a centerline. In this embodiment, the tape may be used as a palette for drawing, or coloring. In yet another embodiment, the invention may include a means for creating sound or vibration imparted from the apparatus. Preferably, the means will emit sound or vibration when the apparatus is moved along a surface. This feature will be helpful to those with visual or hearing loss.

The Inventive Method.

The invention is also a method for instructing and teaching children that incorporates the steps of dispensing decorative tape onto a surface. The method requires one to form housing in a shape of a selected toy, then position a tape coil within the housing. The inventive method will also include the step of cooperatively configuring the tape and housing to emit a ribbon of tape from an underside of the housing. The underside of the housing is configured to engage the surface so that a ribbon of tape adheres thereto.

The inventive method also includes the step of coating a first side of the tape with a gentle and nonpermanent adhesive, and placing selected indicia on the second side of the tape, then moving the housing across the surface. As this is done, tape exits the apparatus and adheres to the surface.

The method may also include the step of biasing the tape into contact with the surface. In preferred embodiments of the method, the indicia on the tape may include alphabetic characters, numerals, animals, railroad tracks, or fruit likenesses, or any other likeness that would be well-suited to stimulate the interests of children or the intended user. Along those lines, the housing may be formed to include the shape of a turtle, train, car, bus, ladybug, insect, animal, plane, or fish, or any other figure that would be well-suited for children.

The method may also include the step of positioning a first roller positioned on the underside of the housing so that the tape rolls across the first roller when the apparatus is moved across the surface. In preferred embodiments, roller is biased to urge the tape into engagement with the surface.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
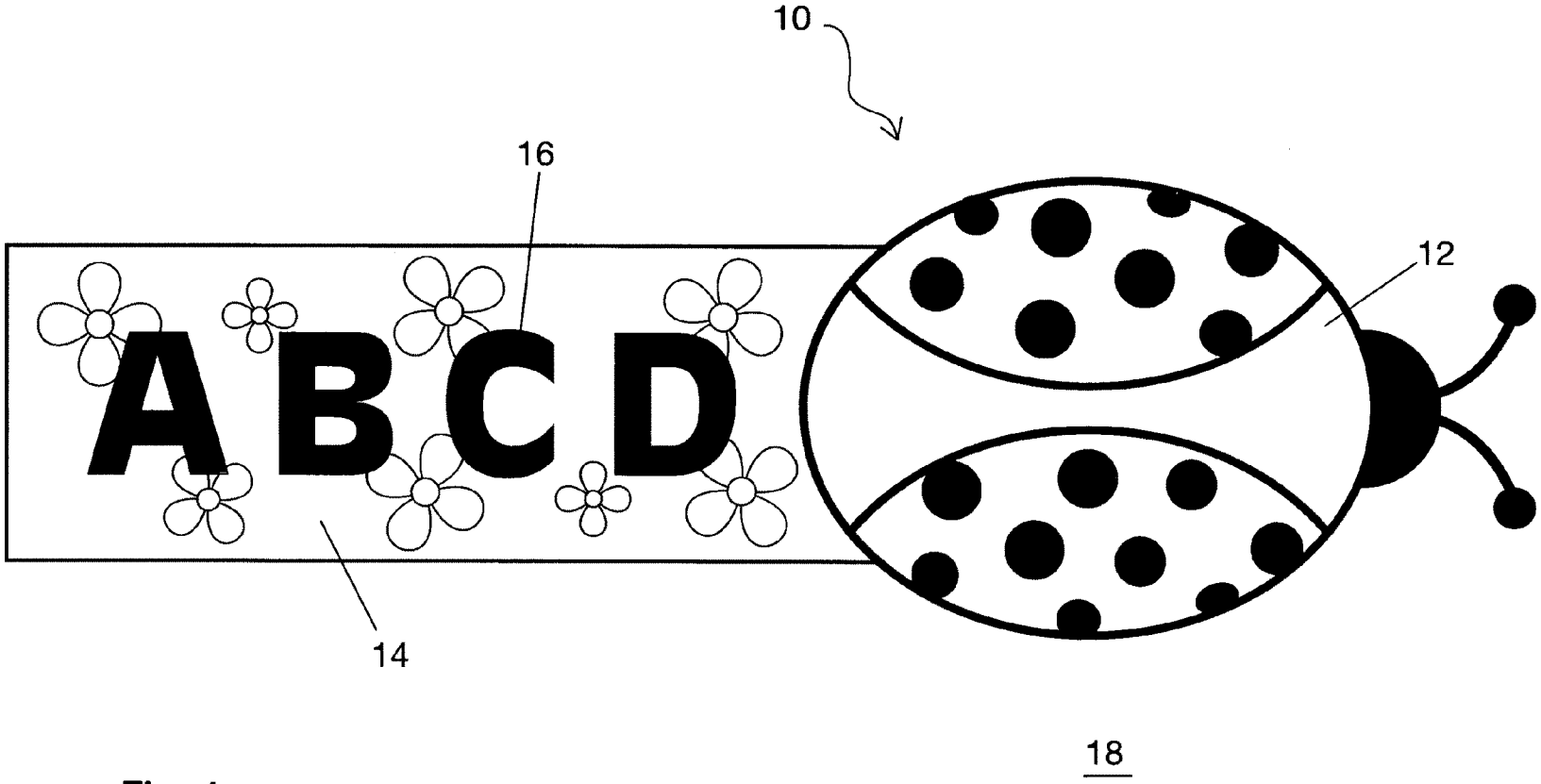
FIG. 1 is a plan view of a first embodiment of the invention.

FIG. 1 is a plan view of the inventive system 10, which includes a housing 12 formed in the shape of a ladybug. The system 10 also includes a tape 14 that extends from the housing 12 and adheres to a surface 18. The tape 14 will bear indicia 16 that may be in the form of alphanumeric characters, fruit likenesses, or the like. As discussed herein, the indicia 16 may also include raised or textured figures that will be palpable and perceptible to the touch. In this regard, the indicia may also include Braille figures so that the system 10 could be well-suited for visually impaired children.

Figure 2:
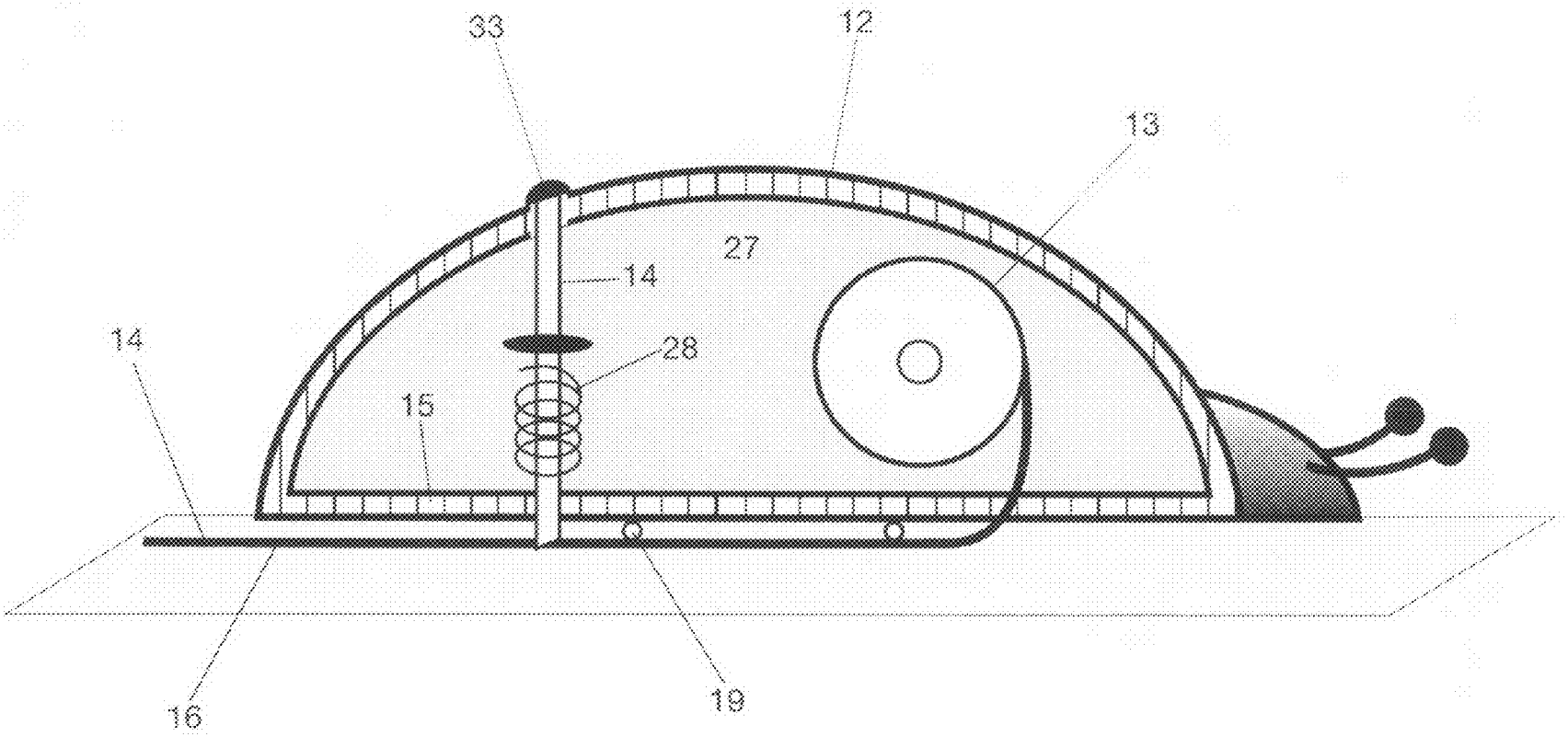
FIG. 2 is a side view showing a cross section of the embodiment shown in FIG. 1.

FIG. 2 is a cross-section of a side-view of the system 10. As shown, the system 10 includes a housing 12 having a tape coil 13 positioned within the housing 12. The tape 14 exits the housing 14 through an opening in the underside 15 of the housing 12.

As shown in FIG. 2, the system 10 may include a biasing means 19 that urges the underside of the tape 14 into contact with the surface 18. The biasing means 19 may be in combination with a first roller across which the tape 14 traverses as the system 10 is moved across the surface 18. Optionally, this embodiment may include a means for turning the coil 13 so that the tape 14 can be re-rolled back onto the coil 13 after it has exited the housing 12.

Still referring to FIG. 2, the system 10 may also include a cutter assembly 27 comprising a shaft 29 that passes through the interior of the housing 12, and has a button 33 extending therefrom at its first end, and a blade assembly (not viewable in FIG. 2, shown aft) at its lower end. A spring 28 biases the blade upwardly into an at-rest position. When a user desires to cut the tape 14, however, the user depresses the button 33, which lowers the cutter into engagement with the tape 14, which will terminate the ribbon.

Figure 3:
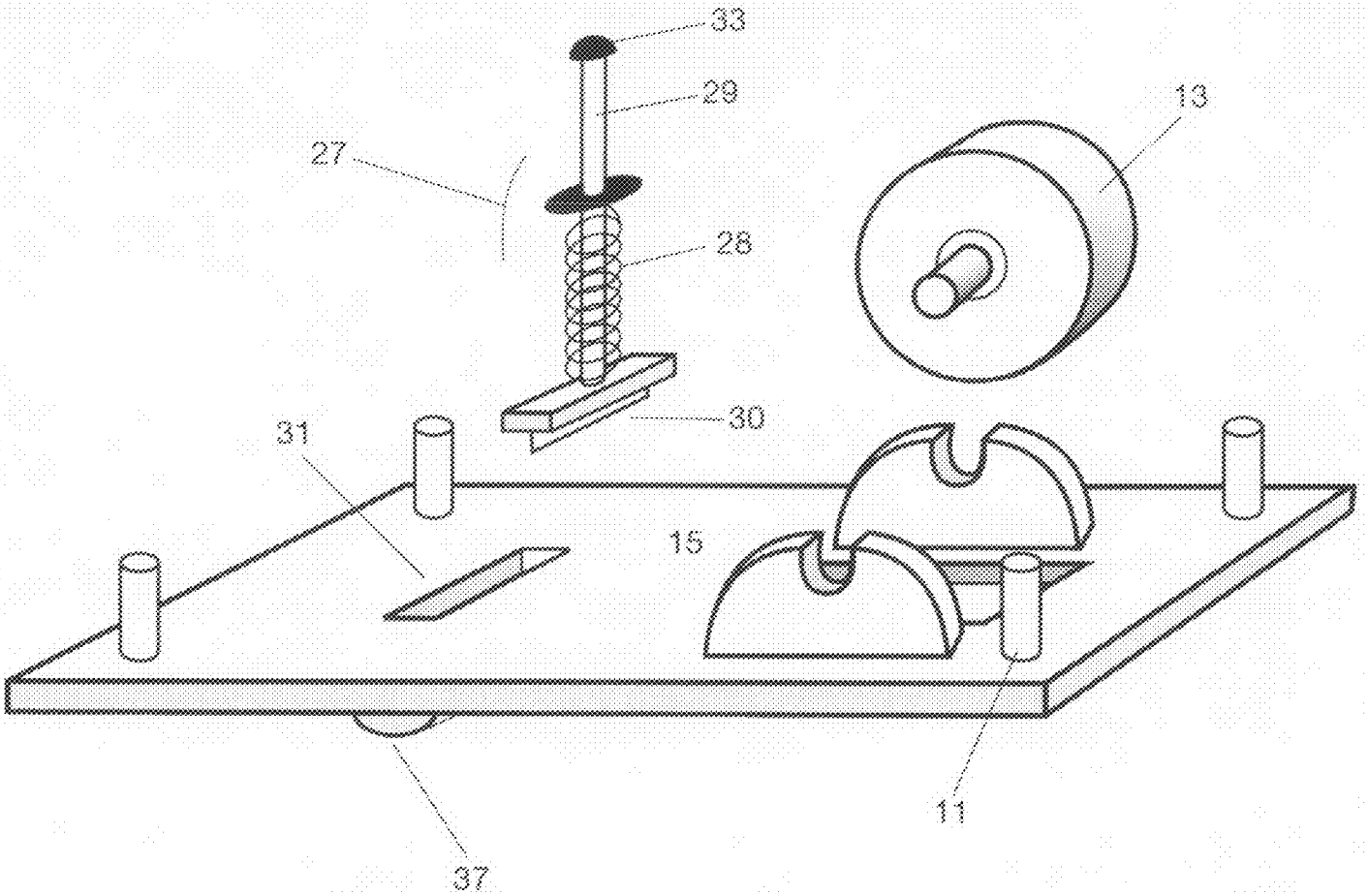
FIG. 3 is a perspective view that isolates the lower portion of the system.

FIG. 3 is a perspective view isolating the lower portion of the system 10. The underside 15 has pegs 11 configured to engage with cooperatively formed receptacles in the housing 12. It is preferred that the pegs 11 snap fit into the receptacles to hold the underside 15 to the housing 12. The cutter assembly 27 includes a shaft 29 that passes from the upper portion of the housing 12 to the underside 15. A button 33 will protrude through the upper portion 12, and a blade 30 will be positioned adjacent a terminus of the shaft 29. The blade 30 will be free to move relatively within an opening 31 formed in the underside 15.

As shown in FIG. 3, a spring 28 (or other biasing means) urges the blade 30 into an at-rest position wherein the blade allows the tape to pass along the underside 15 of the system. When the button 33 is depressed, however, the blade 30 engages and cuts the tape 14. In an alternate embodiment, the opening 31 may have an upper ledge that retains the blade 30 in place within the opening.

Still referring to FIG. 3, a cover 37 may be positioned beneath the opening 31. The cover 37 may be configured so that the tape 14 passes through it. The cover 37 not only shields the blade 30 from exposure and helps retain the blade within the opening 31, but also provides a pressing surface so that the blade can press the tape for expedient cutting without scratching a surface. In that regard, a rounded cover 37 is well-suited, as sharper corners are more prone to scratch.

Figure 4:
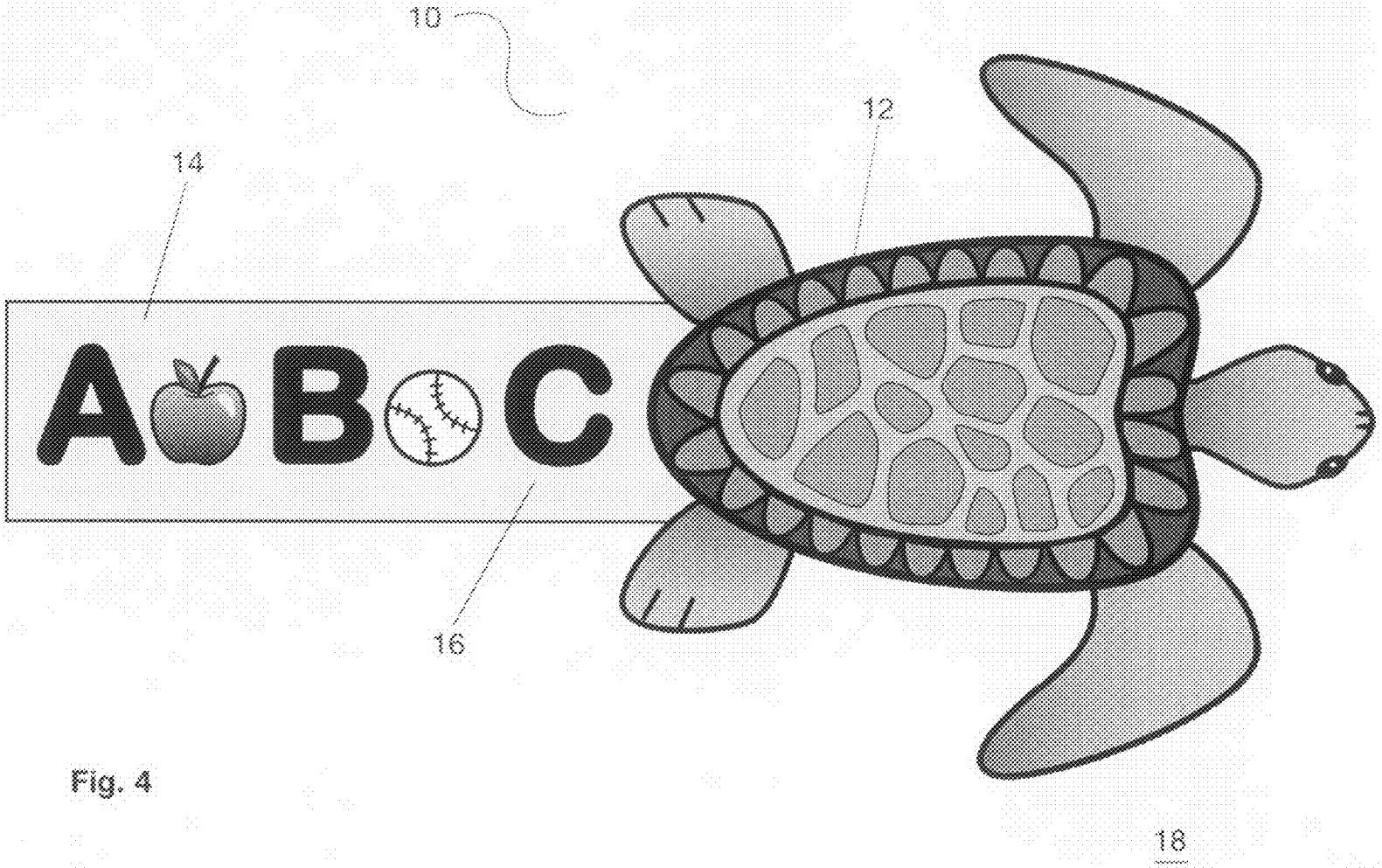
FIG. 4 is a plan view of a second embodiment of the invention.

FIG. 4 shows a plan view of a second embodiment of the system 10, wherein the housing 12 forms the shape of a turtle. In this embodiment, the tape 14 exits the underside 15 of the housing 12 and into engagement with the surface 18. The tape 14 bears indicia 16 in the form of alphabetic characters.

Figure 5:
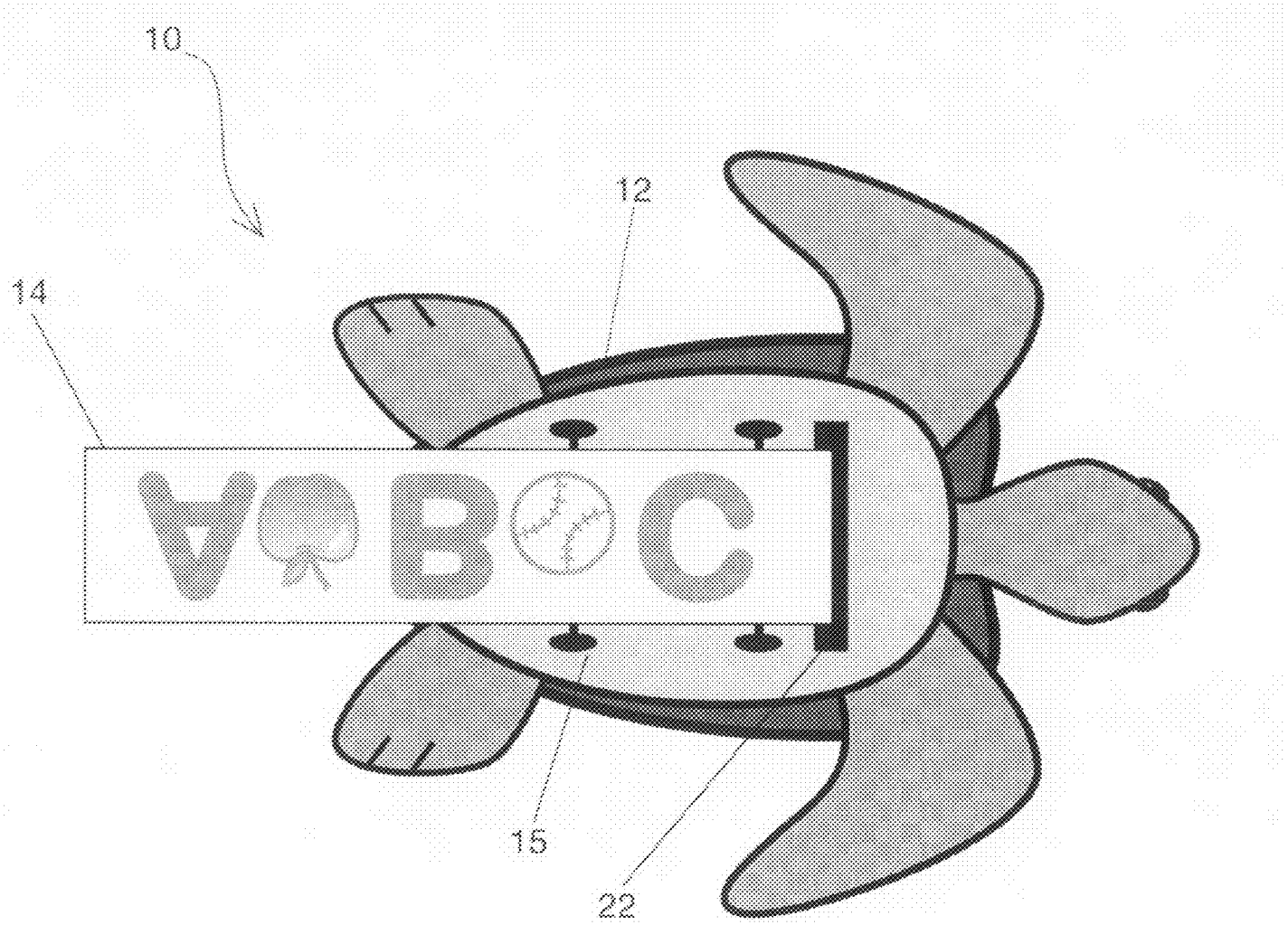
FIG. 5 is an underside view of the embodiment shown in FIG. 4.

FIG. 5 shows the underside of the turtle-shaped housing 12 shown above. The underside 15 of the housing has an opening 22 formed to allow the tape 14 to exit as the housing 12 is moved across a surface. A pair of rollers assist in guiding the tape and/or biasing the tape 14 into engagement with the surface.

It is preferred that the underside 16 of the tape 14 be coated with a gentle, nonpermanent adhesive that will enable the tape to be removed from a surface 18 easily without marring the surface, and may even allow the tape to be re-rolled back on to the coil 13.

Figure 6:
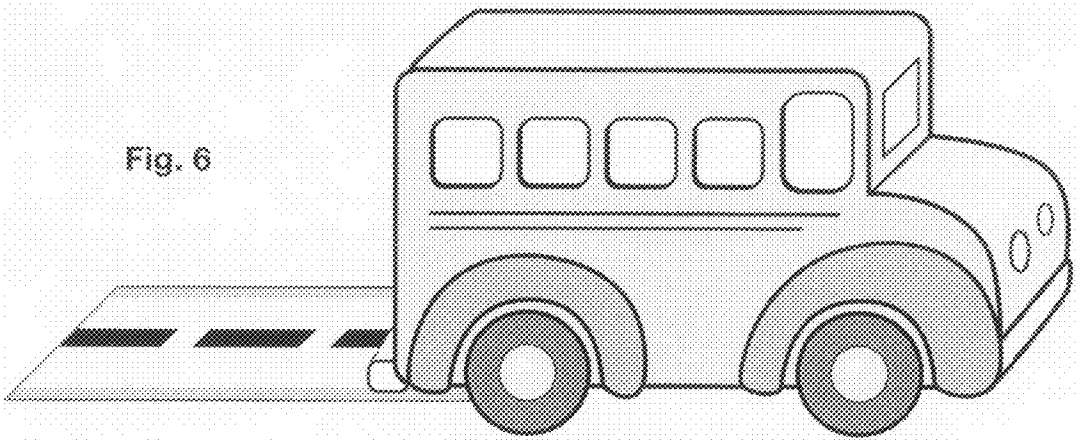
FIGS. 6-8 are comparative perspective views of alternate embodiments of the invention.
Figure 7:
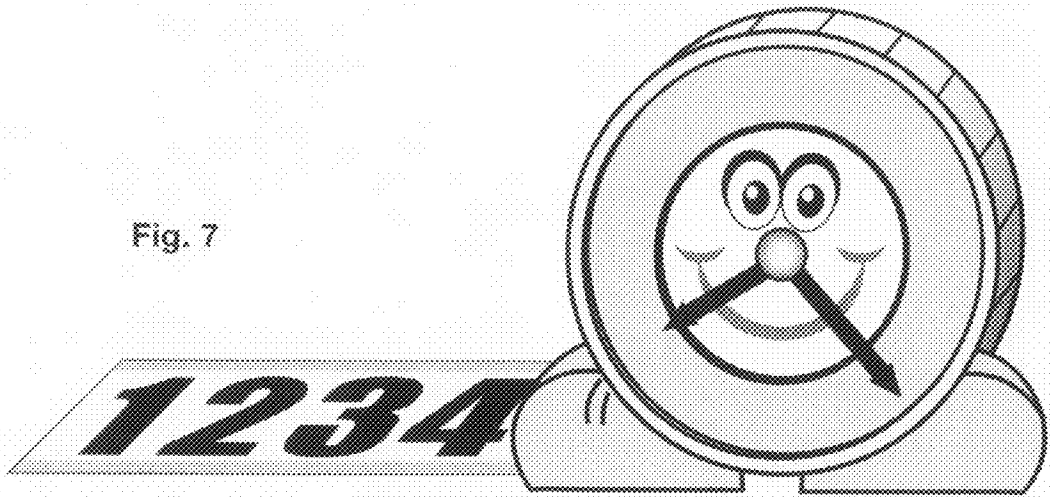
Figure 8:
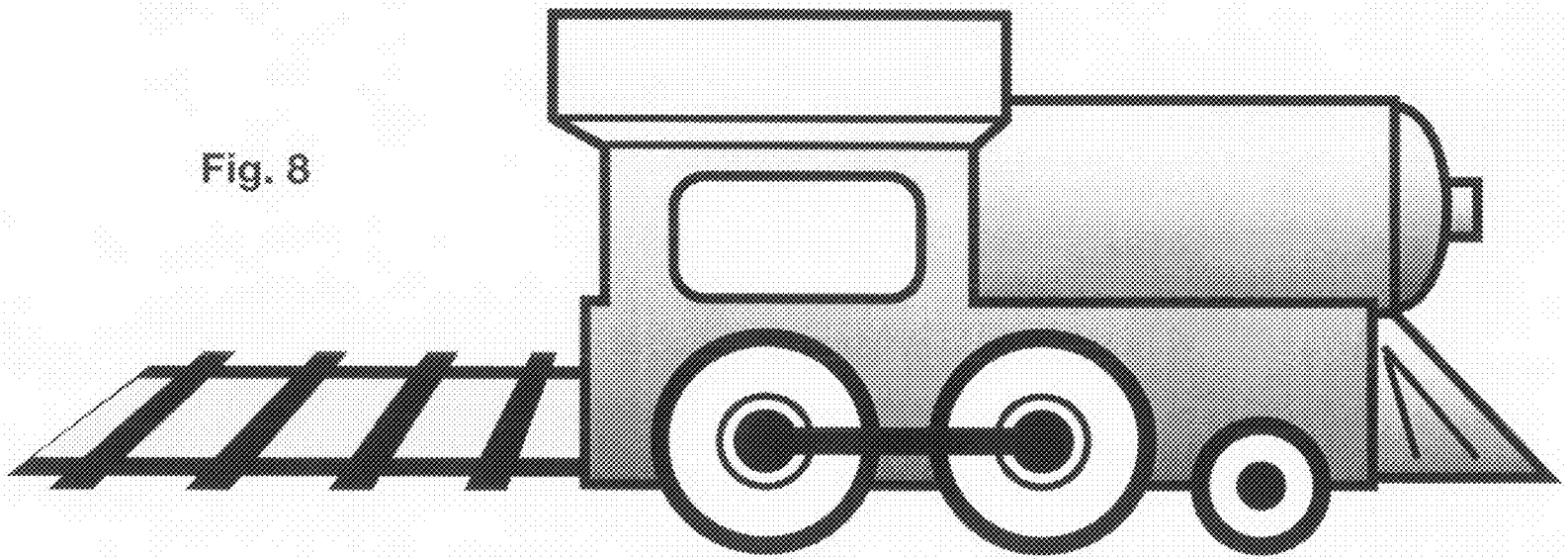

FIGS. 6-8 show perspective views of comparative embodiments of the system 10. In each of the embodiments in FIGS. 6-8, the housing forms the shape of an object that would capture the interest of a child, such as a train, clock, or the like. While these figures show differing shapes for the housing, it is to be understood that the remaining aspects are analogous with other embodiments that are shown in greater detail.

Figure 9:
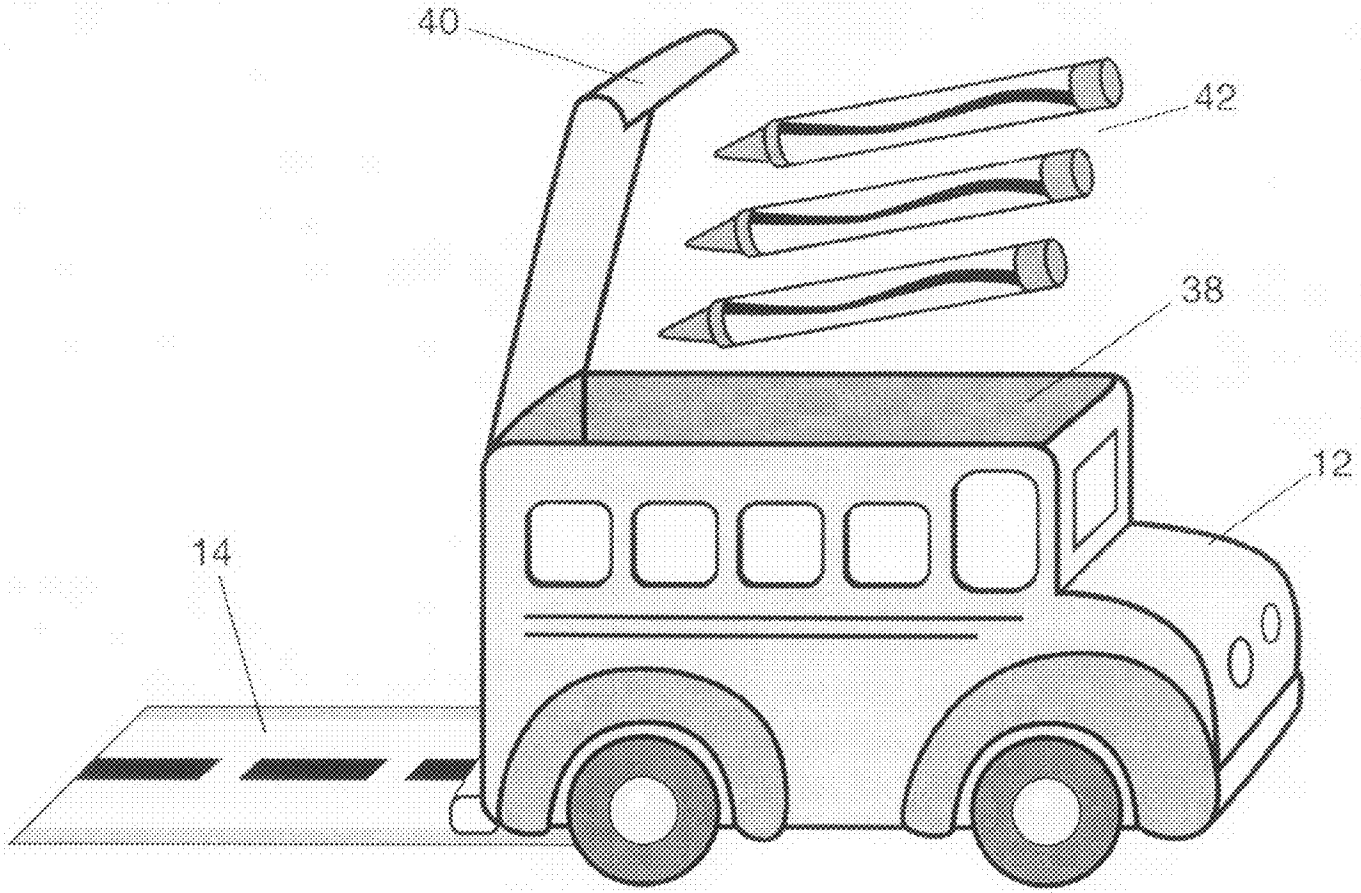
FIG. 9 shows a perspective view of another embodiment of the invention.

FIG. 9 shows a perspective view of an alternate embodiment of the inventive apparatus. In this embodiment, the housing 12 bears a compartment 38 for the storage of markers 42, such as crayons, pencils, or dry-erase type. As shown in FIG. 9, the compartment 38 is encased by top 40 hinged to an edge of the housing 12. In this embodiment, the type of marker is selected to enable one to draw onto the tape as it is adhered to the selected surface. Additionally, it is preferred that the type of marker be selected such that markings can be wiped clean from the surface of the tape 14.

The inventive apparatus may be used as a teaching tool to assist children in development of writing skills. As shown in FIG. 9, the tape 14 bears a likeness of a road having a centerline. Once applied to a surface, however, the tape may serve as writing surface, where the child to practice forming letters or make basic shapes, for example.

Figure 10:
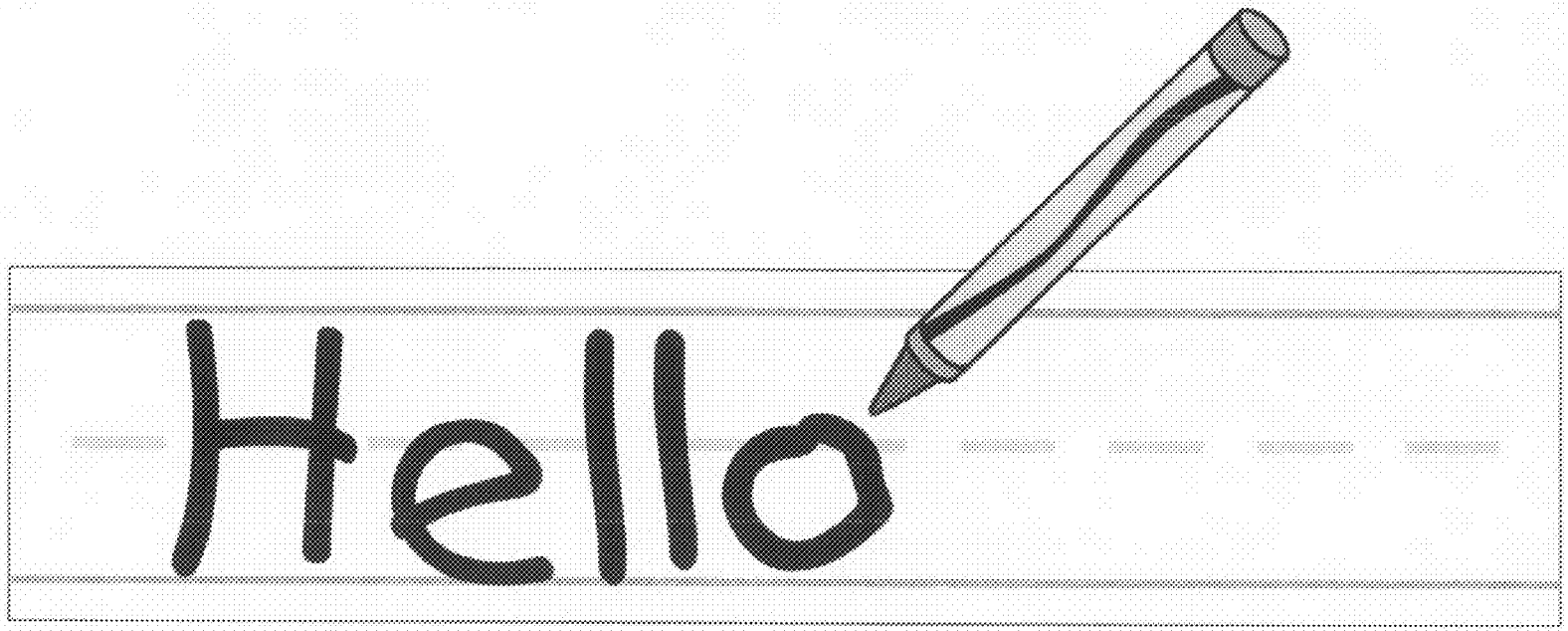
FIGS. 10 and 10A show alternative embodiments for tape that may be included as part of the invention.

FIG. 10 shows an example of how the tape 14 may be used as a writing tablet once applied to a selected surface. Note that the centerlines may serve to guide the children in the formation of lower case and upper-case letters. Preferably, the marker and tape-surface are cooperatively selected so that the drawings may be erased easily, such as dry-erase marker and a tape may be bear a dry-erase finish. This cooperative configuration will enable children to wipe their work clean and re-use the tape or correct mistakes.

Figure 10A:
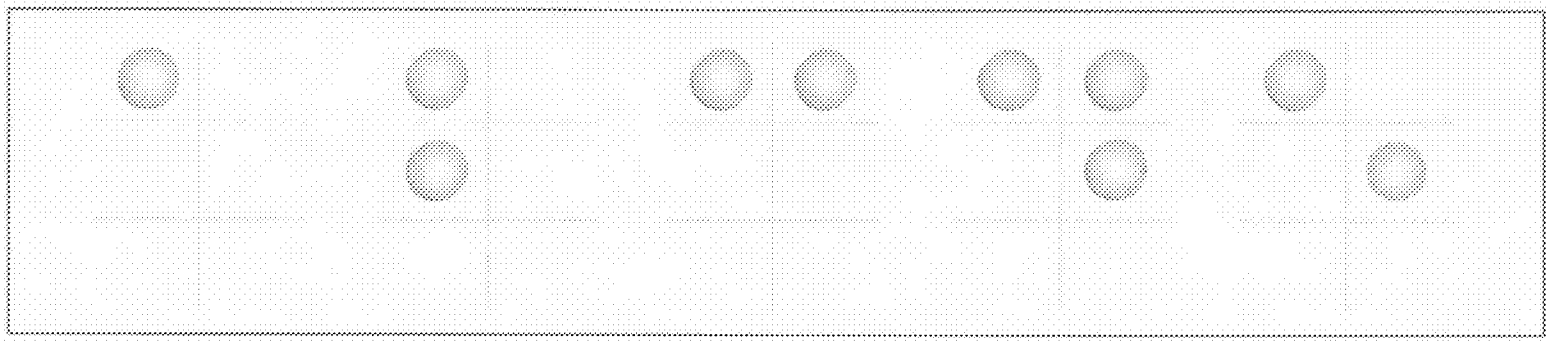

FIG. 10A shows another example of the tape 14, which may include indicia 16 in the form of Braille characters or letters. Of course, other raised, palpable or textured figures on the tape 14 fall within the spirit and scope of the invention as well. Additionally, the invention may also include a means for emitting sound or vibrations, such as the emission of a sound or vibration when the housing is moved across a surface.

Having described the invention and its drawing and diagrams in detail, it is to be understood that these descriptions are for illustrative purposes. The scope and breadth of the invention shall be limited only by the appended claims.

The invention claimed is:

1. An apparatus for dispensing decorative tape onto a surface, the apparatus comprising:

a housing forming a selected toy shape;

a tape coil positioned within the housing and configured to emit tape from an underside of the housing, the underside configured to engage the surface and adhere tape to the surface;

a gentle and nonpermanent adhesive on a first side or the tape; and selected indicia on the second side of the tape;

a means for biasing the tape into contact with the surface, the biasing means positioned exterior the housing;

wherein, as the apparatus is moved across the surface, the tape exits the apparatus and adheres to the surface.

2. The apparatus as in claim 1, wherein the indicia comprise at least one of alphabetic characters, numerals, animals, railroad tracks, or fruit likenesses.

3. The apparatus as in claim 1, the tape comprising a writing surface.

4. The apparatus as in claim 1, wherein the tape includes at least one of raised portions and textured portions.

5. The apparatus as in claim 4, wherein the indicia includes Braille writing.

6. The apparatus as in claim 1, wherein the selected toy shape is one of a turtle, train, ear, bus, ladybug, insect, animal, plane, or fish.

7. The apparatus as in claim 1, further comprising a first roller positioned on the underside of the housing; wherein, the tape rolls across the first roller when the apparatus is moved across the surface.

8. The apparatus as in claim 1, the housing further including a compartment having a top hinged to an edge and selectively positionable between a closed position and an open position.

9. The apparatus as in claim 8, further comprising marking utensils stored within the compartment.

10. A method for dispensing decorative tape onto a surface, the method including the steps of:

forming a housing in a shape of a selected toy;

positioning a tape coil within the housing;

cooperatively configuring the tape coil and housing to emit tape from an underside of the housing, the underside configured to engage the surface so that the tape adheres thereto;

positioning a biasing means exterior the housing for urging the tape into contact with the surface;

coating a first side of the tape with a gentle and nonpermanent adhesive;

placing selected indicia on the second side of the tape;

wherein, as the apparatus is moved across the surface, the tape exits the apparatus and adheres to the surface.

11. The method as in claim 10, wherein the indicia comprise at least one of alphabetic characters, Braille writing, numerals, animals, railroad tracks, or fruit likenesses.

12. The method as in claim 10, wherein the selected toy shape is one of a turtle, train, car, bus, ladybug, insect, animal, plane, or fish.

13. The method as in claim 10, further comprising the steps of positioning a first roller positioned on the underside of the housing; and wherein, the tape rolls across the first roller when the apparatus is moved across the surface.

14. The method as in claim 10, further comprising the steps of selecting a second side of the tape to be a writing surface;

writing on the second side of the writing surface.

15. The method as in claim 14, further comprising the step of erasing the writing on the second side of the writing surface.

16. The method as in claim 10, farther comprising the step of creating a compartment within the housing by positioning a removable cover on the housing.

17. The method as in claim 10, further comprising the step of providing at least one of a means for emitting sound or a moans for vibration.

* * * * *